US006752679B1

(12) United States Patent
Lui

(10) Patent No.: US 6,752,679 B1
(45) Date of Patent: Jun. 22, 2004

(54) DOUBLE DOLL FIGURINE

(76) Inventor: Hoe King Lui, 21 Floor, Mirage Tower, 15 Thomson Road, Wanchai (HK)

( * ) Notice: Subject to any disclaimer, the term of this patent is extended or adjusted under 35 U.S.C. 154(b) by 0 days.

(21) Appl. No.: 10/718,214

(22) Filed: Nov. 19, 2003

(51) Int. Cl.[7] ..... A63H 3/00
(52) U.S. Cl. ..... 446/69; 446/321
(58) Field of Search ..... 446/69, 72, 73, 446/97, 99, 101, 268, 321; 273/156, 157 R

(56) References Cited

U.S. PATENT DOCUMENTS

| | | | | |
|---|---|---|---|---|
| 784,888 | A | 3/1905 | Reisner | |
| 2,351,762 | A | 6/1944 | Hoover | |
| 2,942,379 | A | 6/1960 | Oman et al. | |
| 3,546,789 | A | * 12/1970 | Kushell et al. | 434/260 |
| 3,779,558 | A | * 12/1973 | Moreau | 273/157 R |
| 3,805,444 | A | 4/1974 | Adickes | |
| 3,961,439 | A | * 6/1976 | Moustakas | 446/99 |
| 5,545,069 | A | 8/1996 | Glynn et al. | |
| 6,139,396 | A | 10/2000 | Lin | |
| D483,819 | S | * 12/2003 | Pino | D21/630 |

* cited by examiner

*Primary Examiner*—Jacob K. Ackun, Jr.
(74) *Attorney, Agent, or Firm*—Jack C. Munro

(57) ABSTRACT

A double doll figurine which is constructed of an outer doll which is constructed of an outer doll which has a hollow internal chamber and within the hollow internal chamber is to be located an inner doll. The outer doll is constructed of a top and a base which are capable of being separated. When the top and base are connected together, they are connected by a fastener arrangement with generally a magnetic fastener arrangement being preferred. Each of the magnetic fasteners is mounted within a post mounted in the base with each of these posts protruding within the internal chamber. The posts cooperate with members of the inner doll to restrict the movement of the inner doll within the internal chamber so the posts, in essence, function as a movement limiter.

10 Claims, 2 Drawing Sheets

DOUBLE DOLL FIGURINE

BACKGROUND OF THE INVENTION

1. Field of the Invention

This invention pertains particularly to figurines and more particularly to a figurine that is constructed of an outer doll and an inner doll with the inner doll being mounted within a hollow interior internal chamber of the outer doll.

2. Description of the Related Art

Doll type figurines have long been known. It has also been known to construct doll type figurines of an outer doll within which is mounted an inner doll. However, in the past the inner doll has a tendency to move within the internal chamber of the outer doll and this movement may be sufficient to cause damage to the exterior surface of the inner doll. The figurine, after being constructed, may be shipped extensively before it is actually purchased by the consumer. During this shipping is when damage to the inner doll can occur by the inner doll moving back and forth within the internal chamber of the outer doll.

It would be desirable to design in conjunction with double doll figurines some structural arrangement that would limit the movement of the inner doll relative to the outer doll.

SUMMARY OF THE INVENTION

A double doll figurine constructed of an outer doll formed of a base and a top with the top being separable from the base. The outer doll has an internal chamber. The base has a first fastener assembly with the first fastener assembly comprising a pair of fastener members each mounted on a separate post that protrudes within the internal chamber. The top has a second fastener assembly that is to engage with the first fastener assembly when the top is mounted on the base. The inner doll has laterally protruding members each of which is capable of abutting against one of the posts so the posts function as a movement limiter tending to keep the inner doll from moving significantly within the internal chamber.

A further embodiment of the present invention is where the basic embodiment is modified by the laterally protruding members of the inner doll being defined as arms.

A further embodiment of the present invention is where the basic embodiment is modified by the first fastener members being located diametrically opposite each other relative to the internal chamber.

A further embodiment of the present invention is where the basic embodiment is modified by the first fastener assembly being defined as including magnets.

A further embodiment of the present invention is where the just previous embodiment is modified by the second fastener assembly being defined as comprising a pair of metallic members that engage with the magnets.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
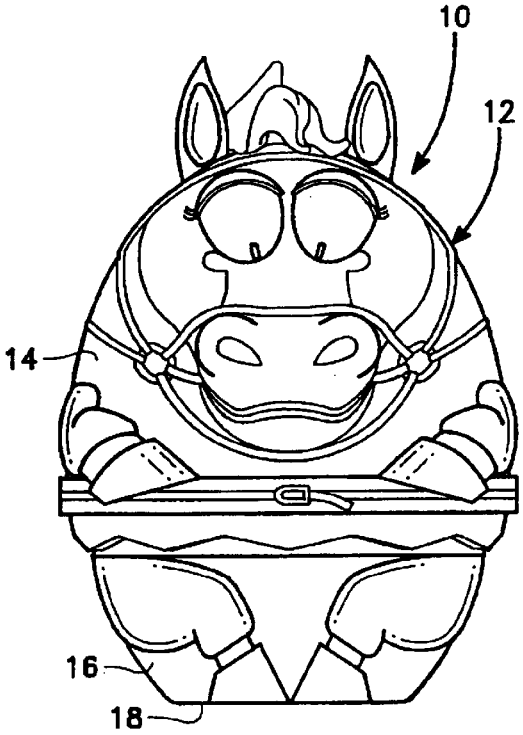
FIG. 1 is an exterior front elevational view of the double doll figurine of this invention.
Figure 2:
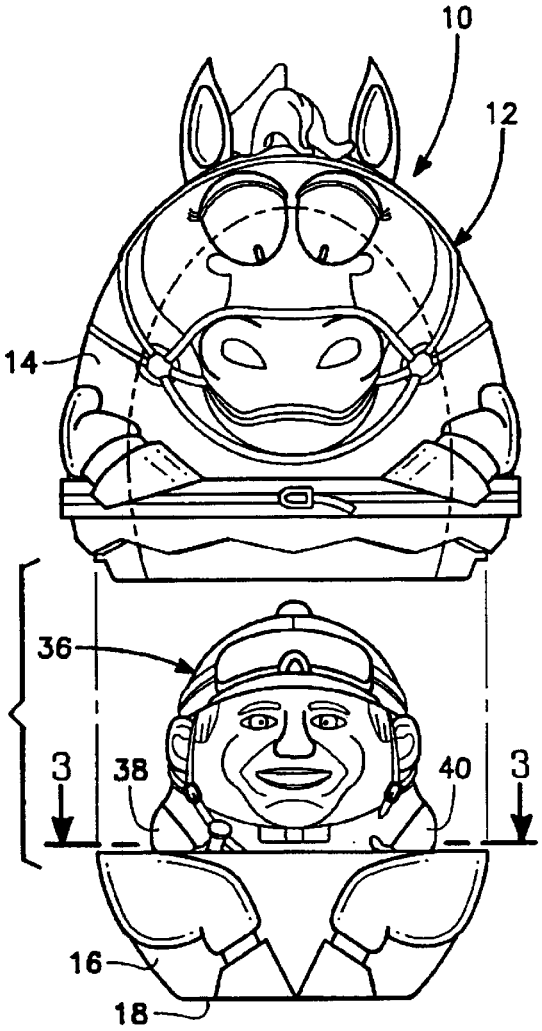
FIG. 2 is a view similar to FIG. 1 but with the top of the outer doll being removed from the base of the outer doll exposing the inner doll that is located within the internal chamber of the outer doll.
Figure 3:
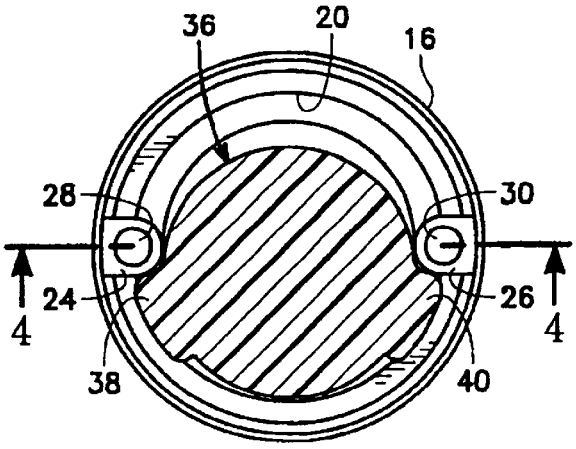
FIG. 3 is a cross-sectional view taken along line 3—3 of FIG. 2 showing the connection between the fastener posts of the outer doll with the arms of the inner doll which function as the movement limiter for the inner doll.
Figure 4:
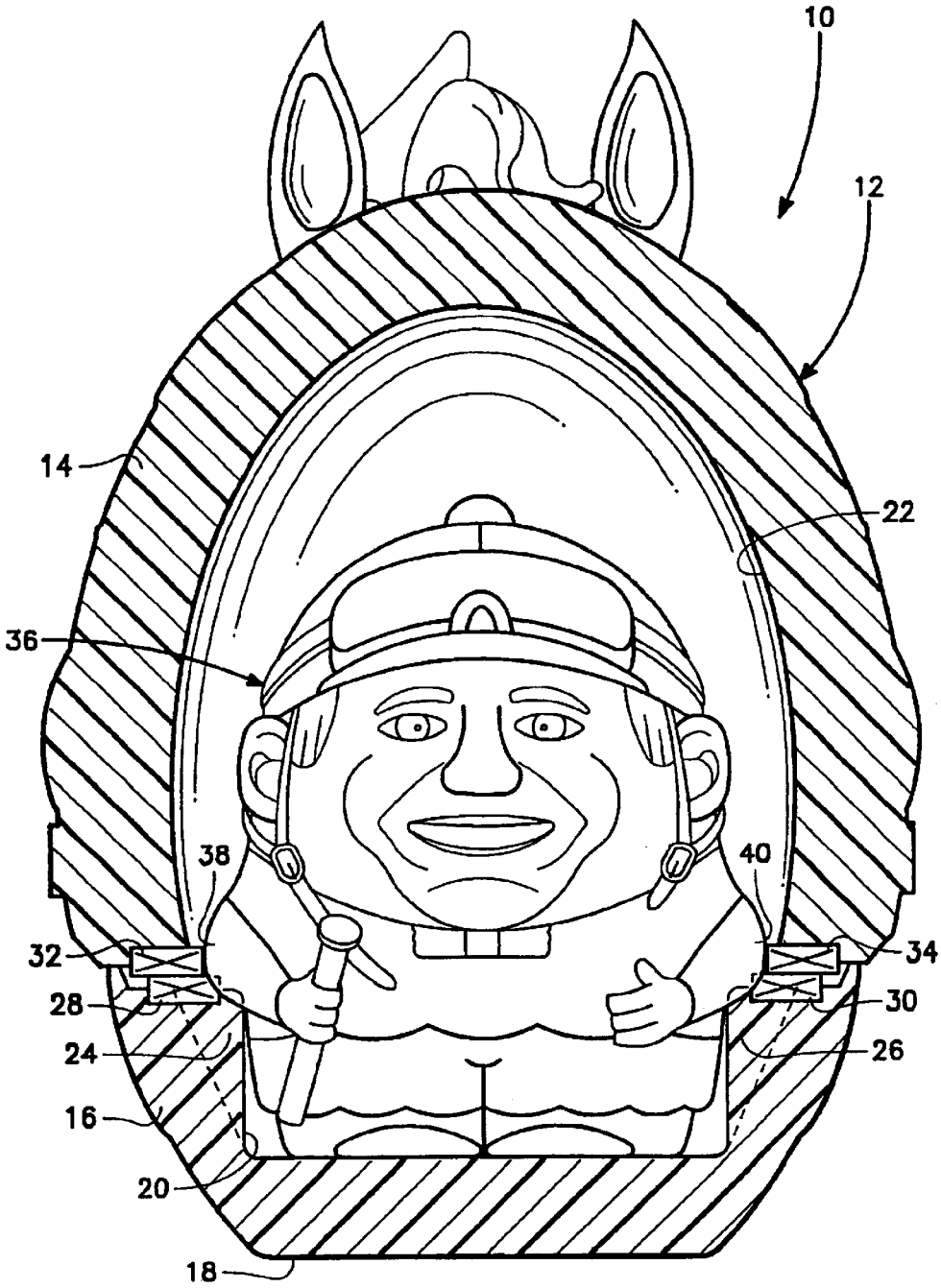
FIG. 4 is a cross-sectional view taken along line 4—4 of FIG. 3 but where the inner doll is not cut but is shown in its exterior configuration and also showing the connection between the arms of the inner doll and the fastener posts of the base of the outer doll.

Referring particularly to the drawings, there is shown the figurine 10 of this invention and specifically the exterior surface of the outer doll 12. The exterior surface of the outer doll 12 can be made of any numerous configurations, such as for example, the caricature of a horse, which is shown. However, it is within the scope of this invention that numerous other configurations could be used, such as that of baseball players, football players, or any other type of sport or non-sport type figures. The outer doll 12 is composed of a top 14 and a base 16. The base 16 has a flat bottom 18 which is to permit the figurine 10 to rest on a supporting surface, such as a table, desk, or other similar type of furniture.

The base 16 is hollowed out forming an internal chamber 20. In a similar manner, the interior of the top 14 is also hollowed out forming an internal chamber 22. The internal chambers 20 and 22 cooperate together when the top 14 is mounted on the base 16 forming a single internal chamber. It is to be understood that the figurine 10 of this invention will be constructed of any desirable rigid material, such as porcelain, ceramic, wood, plastic and the like.

The base 16 includes a pair of posts 24 and 26. These posts 24 and 26 are integral with the base 16. Mounted within the posts 24 is a fastener in the form of a first magnet 28. A similar fastener is mounted on the post 26 in the form of a second magnet 30. Magnet 28 is to connect with metallic member 32 and magnet 30 is to connect with metallic member 34. Metallic members 32 and 34 are mounted on the top 14 and located diametrically opposite each other relative to the internal chamber 22. The same is also true of magnets 28 and 30 that are located diametrically opposite each other relative to the internal chamber 20. It is considered to be within the scope of this invention that the magnet 28 could be instead a metallic member with the metallic member 32 actually be a magnet. The same is also true in the arrangement relative to magnet 30 and metallic member 34. It is also considered to be within the scope of this invention that other types of securement could be utilized instead of the magnet arrangement shown within this invention. For example, there may be some form of physical interlocking fasteners composed of a male and a female interengaging members.

The posts 24 protrudes within the confines of the internal chamber 20. The same is true of the posts 26. There is an inner doll 36 which has an exterior caricature configuration mounted within the internal chamber composed of internal chambers 20 and 22. This inner doll 36 has laterally protruding members shown to be in the configuration of arms 38 and 40. Arm 38 interconnects with post 24 and arm 40 interconnects with post 26 so that posts 24 and 26 function to limit the movement of the inner doll 36 within the internal chambers 20 and 22 during transporting movement of the figurine which will generally be by shipping. Therefore, the arms 38 and 40 in conjunction with posts 24 and 26 respectively restrain the amount of movement of the inner doll 36 relative to the outer doll 12.

It can thus be seen that a cute doll configuration is achieved by the double doll figurine of the present invention. As previously mentioned, not only can there be sports figures, such as a horse and a jockey, a pair of baseball players, a pair of football players and so forth, but there also could be a medical doctor and nurse, a lawyer and secretary, and so forth combined together into the figurine. These two figurines combined in one unit seems to be a product that is desirable by a substantial number of people and is therefore purchased by these people.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation. Particularly, it should be understood that as the disclosure relates to elements of the invention, the words for each: element may be expressed by equivalent apparatus terms or method terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A double doll figurine comprising:

an outer doll having a first exterior caricature representation, said outer doll being constructed of a base and a top, said top being separable from said base, said outer doll having an internal chamber;

said base having a first fastener assembly, said first fastener assembly comprising a pair of first fastener members each mounted on a separate post that protrudes within said internal chamber;

said top having a second fastener assembly that is to engage with said first fastener assembly when said top is mounted on said base; and an inner doll having a second exterior caricature representation adapted to be located within said internal chamber, said inner doll having laterally protruding members each of which is capable of abutting against a said post so said posts function as a movement limiter tending to keep said inner doll from moving significantly within said internal chamber.

2. The double doll figurine as defined in claim 1 wherein:

said laterally protruding members defining a pair of arms of said inner doll.

3. The double doll figurine as defined in claim 1 wherein:

said pair of first fastener members being mounted diametrically opposite each other relative to said internal chamber.

4. The double doll figurine as defined in claim 1 wherein:

each of said pair of first fastener members comprising a magnet.

5. The double doll figurine as defined in claim 4 wherein:

said second fastener assembly comprising a pair of second fastener members, each said second fastener member is to engage with a said first fastener member, each said second fastener member being constructed of metal.

6. A double doll figurine comprising:

an outer doll, said outer doll being constructed of a base and a top, said top being separable from said base, said outer doll having an internal chamber;

said base having a first fastener assembly, said first fastener assembly comprising a pair of first fastener members each mounted on a separate post that protrudes within said internal chamber;

said top having a second fastener assembly that is to engage with said first fastener assembly when said top is mounted on said base; and an inner doll adapted to be located within said internal chamber, said inner doll having laterally protruding members each of which is capable of abutting against a said post so said posts function as a movement limiter tending to keep said inner doll from moving significantly within said internal chamber.

7. The double doll figurine as defined in claim 6 wherein:

said laterally protruding members defining a pair of arms of said inner doll.

8. The double doll figurine as defined in claim 6 wherein:

said pair of first fastener members being mounted diametrically opposite each other relative to said internal chamber.

9. The double doll figurine as defined in claim 6 wherein:

each of first said pair of fastener members comprising a magnet.

10. The double doll figurine as defined in claim 9 wherein:

said second fastener assembly comprising a pair of second fastener members, each said second fastener member is to engage with a said first fastener member, each said second fastener member being constructed of metal.

* * * * *